US009889913B1

(12) United States Patent
Hundertmark

(10) Patent No.: US 9,889,913 B1
(45) Date of Patent: Feb. 13, 2018

(54) MARINE POWER STEERING SYSTEM

(71) Applicant: Mark X Steering Systems, LLC, Devils Lake, ND (US)

(72) Inventor: James M. Hundertmark, Fond du Lac, WI (US)

(73) Assignee: MarineTech Products, Inc., Vadnais Heights, MN (US)

( * ) Notice: Subject to any disclaimer, the term of this patent is extended or adjusted under 35 U.S.C. 154(b) by 0 days.

(21) Appl. No.: 15/067,665

(22) Filed: Mar. 11, 2016

Related U.S. Application Data

(60) Provisional application No. 62/132,627, filed on Mar. 13, 2015.

(51) Int. Cl.
*B63H 20/08* (2006.01)
*B63H 20/12* (2006.01)

(52) U.S. Cl.
CPC ..... *B63H 20/12* (2013.01)

(58) Field of Classification Search
CPC ..... B63H 20/12; B63H 20/08
USPC ..... 91/376 R; 440/60, 61 R, 61 S, 61 A, 440/61 B, 61 C
See application file for complete search history.

(56) References Cited

U.S. PATENT DOCUMENTS 4,744,777 A 5/1988 Ferguson
5,213,527 A * 5/1993 Fetchko ..... B63H 21/265 114/150
5,241,894 A 9/1993 Hundertmark
7,681,513 B1 * 3/2010 Hundertmark ..... B63H 20/12 114/144 R

FOREIGN PATENT DOCUMENTS

EP 0 671 320 A1 9/1995
GB 2 159 483 A 12/1985

OTHER PUBLICATIONS

Schematic Drawing of Flow Limiting Check Valve from Oildyne 165/175 Series Pump; On or before Jan. 1, 2012.

* cited by examiner

*Primary Examiner* — Anthony D Wiest
(74) *Attorney, Agent, or Firm* — Boyle Fredrickson, S.C.

(57) ABSTRACT

A power steering system for a marine steering includes a hydraulic cylinder, an actuator block that is mounted on an outer end of a ram of the cylinder, and valving. In one embodiment, the valving is located in the hydraulic cylinder and includes at least one flow limiting valve that, through an initial portion of a stroke thereof, limits fluid flow rates through the valve to a generally constant, relatively low level. This limits the rate of extension or retraction of the ram out of or into the barrel and prevents valve chatter. In another embodiment the valving includes ball-type check valves that are located within the actuator block and that are actuated by a rocker arm assembly in the actuator block.

5 Claims, 7 Drawing Sheets

MARINE POWER STEERING SYSTEM

CROSS REFERENCE TO RELATED APPLICATION

The present application claims priority under 35 U.S.C. § 119(e) to U.S. Provisional Patent Application Ser. No. 62/132,627, filed Mar. 13, 2015 and entitled Flow Control Valve for Marine Power Steering System, the contents of which are hereby incorporated by reference in their entirety.

BACKGROUND OF THE INVENTION

I. Field of the Invention

The invention relates to marine power steering systems and, more particularly, to a hydraulically-actuated marine power steering system providing pressurized hydraulic fluid for the system. The invention additionally relates to an actuator for such a system that limits flow during at least initial and closing phases of actuator operation so that the steering rate is less than maximum. The invention additionally relates to improved valving for the actuator of the system.

II. Description of Related Art

Typically, marine power steering systems for outboard motors and stern drives utilize an extendible and contractible steering ram or rod connected to the boat transom and to the propulsion unit. Extension and contraction of the piston ram causes the propulsion unit to pivot and steer the boat. Such units require a rather large hydraulic pump since rather large volumes of hydraulic fluid are required if the steering is moved rapidly from one side to the other. Two such systems are in use today. One of the systems uses a continuous running electric powered pump which requires a high output electrical charging system to keep the system's battery charged. Most engines in the marketplace do not possess an adequate charging system, which limits the use of such a system. The second system uses an electrically-powered pressure amplifier that is placed between a standard hydraulic helm and a steering cylinder on the engine. The pressure amplifier turns on and off every time a steering input is generated. The power requirement of this system is not as severe as one having a continuously running pump, but it is significant.

Both systems have a limited maximum volume output. In a rapid steering situation, the volume of fluid needed to steer the engine exceeds the maximum volume output of the power supply. The effect of power steering thus can be lost.

To help counter this effect, helms have been designed to increase the number of steering wheel turns required to steer the engine from one side to the other. A traditional "three turn system" requiring three steering wheel revolutions to maximize the helm's steering angle now requires four or five turns. The requirement for additional turns makes it more difficult for the operator to overun the output of the power supply. However, system responsiveness is degraded, hindering docking or other precise maneuvers.

More recently, systems have been introduced that use an accumulator to store pressurized hydraulic fluid, permitting the use of smaller pumps requiring less power. Such a system is disclosed in U.S. Pat. No. 5,241,894 (the '894 patent). The system disclosed in the '894 patent includes a pump that provides pressurized hydraulic fluid from a reservoir and a control system to selectively place the pump in an operative or inoperative mode. The hydraulic system is also provided with a valve that selectively provides pressurized hydraulic fluid to a double acting hydraulic cylinder to cause extension or retraction of the piston ram in the cylinder.

The system disclosed in the '894 patent works well but has some drawbacks.

For example, internal "extend" and "retract" valves, located in the barrel of the hydraulic cylinder, control fluid flow into and out of the respective ends of the hydraulic cylinder to extend and retract the cylinder ram and, thus, steer the engine to in one direction or the other. Traditional valves have relatively linear flow characteristics such that the "flow area" or minimum cross sectional area of the flow path surrounding the valve at any point in the valve's opening stroke and that thus fluid flow rate through each valve at a given pressure increases linearly throughout at least most of the operating stroke of the valve. As a result, ram motion is relatively rapid, even for relative small inputs. This can result in "chatter" at low steering inputs occurring when the valve repeatedly opens and close as ram extension or retraction speed exceeds the steering input speed.

The need therefore exists to provide improved control of a marine power steering system actuator at relatively small inputs.

Another problem associated with the system disclosed in the '894 patent and commercial version of that system is that its valving is relatively difficult to assemble or replace because it is located in the barrel of the hydraulic cylinder as opposed to in the actuator block. It also must be manufactured to close tolerances and is relatively difficult to seal.

Thus, there remains room for improvement.

SUMMARY OF THE INVENTION

In accordance with an aspect of the invention, a power steering system for a marine steering system includes at least one flow limiting valve that, through a substantial portion of a stroke thereof, limits fluid flow rates through the valve to a relatively low value during the early phases of valve opening, limiting the rate of extension or retraction of the ram out of or into the barrel of the system's hydraulic cylinder.

The flow limiting valve may be configured such the flow rate through the flow limiting valve valves remains at a relatively low and generally constant value through a substantial portion of the operating stroke thereof and thereafter increases progressively, possibly non-linearly, during at least another substantial portion of the operating stroke.

The flow limiting valve may have a body that is located within the bore when the valve is closed and that has a first portion of greater diameter than the remainder of the body. An annular gap, formed between the surface of the bore and the first portion of the body, defines a flow path through the valve of small cross-sectional area. The flow limiting valve may additionally have an upstream metering portion that extends axially and radially inwardly into the bore from the first portion and that extends radially inwardly, creating a flow path through the valve that increases progressively in cross sectional area with continued valve movement.

The flow limiting valve may be an extend valve which, when actuated, causes the ram of the system's cylinder to extend from the barrel at a rate that is dependent on a magnitude of extend valve movement from its closed position. The system may additionally include another flow limiting valve forming a retract valve which, when actuated, causes the ram to retract into the barrel at a rate that is dependent on a magnitude of retract valve movement from its closed position.

In accordance with another aspect of the invention, a method of operating a marine power steering system may include imposing manual steering forces on an actuator, the actuator being mounted on a ram of a piston and cylinder assembly and being movable through an actuator stroke. In response to the imposition of the manual forces on the actuator, a flow limiting valve may open to permit fluid to flow within the piston and cylinder assembly at a generally constant, lower than maximum, flow rate through at least an initial portion of the actuating stroke of the actuator, thereby causing the ram to move relative to the barrel at a reduced rate.

The fluid flow rate through the flow limiting valve may increase from zero to a low value, then remain at the low valve during a first subsequent portion of the actuator stroke, and then increases to a high value during a second subsequent portion of the actuator stroke. The fluid flow rate through the valve may then increase progressively and non-linearly during the second subsequent portion of the actuating stroke.

The imposition of manual forces in a first direction may actuate an extend valve to cause the ram to extend from the barrel at a rate that is dependent on a magnitude of actuator movement, and imposition of manual forces in a second direction may actuate a retract valve to cause the ram to retract into the barrel at a rate that is dependent on a magnitude of actuator movement.

In accordance with yet another aspect of the invention, a power steering system for a marine steering system includes a hydraulic cylinder having a barrel and a ram that moves into and out of one end of the barrel, an actuator block that is mounted on an outer end of the ram, an actuator, and valving. The actuator is mounted on the actuator block. The actuator is configured to move on the actuator block upon the transmission of steering command forces thereto. The valving is located within the actuator block and is configured to control the flow of hydraulic fluid to and from the hydraulic cylinder to cause the ram to extend into the barrel and retract from the barrel.

The valving may comprise ball-type extend and retract check valves located in the actuator block. The valves may be located on opposite sides of an axial centerline of the ram, in which case the actuator may include a rocker assembly that rocks is responsive to actuator movement to actuate the extend and retract valves. The rocker assembly may include first and second rocker arms, each of which is associated with a respective one of the extend valve the retract valve.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof; and the invention includes all such modifications

BRIEF DESCRIPTION OF DRAWINGS

Preferred exemplary embodiments of the invention are illustrated in the accompanying drawings, in which like reference numerals represent like parts throughout, and in which.

DETAILED DESCRIPTION

Figure 1:
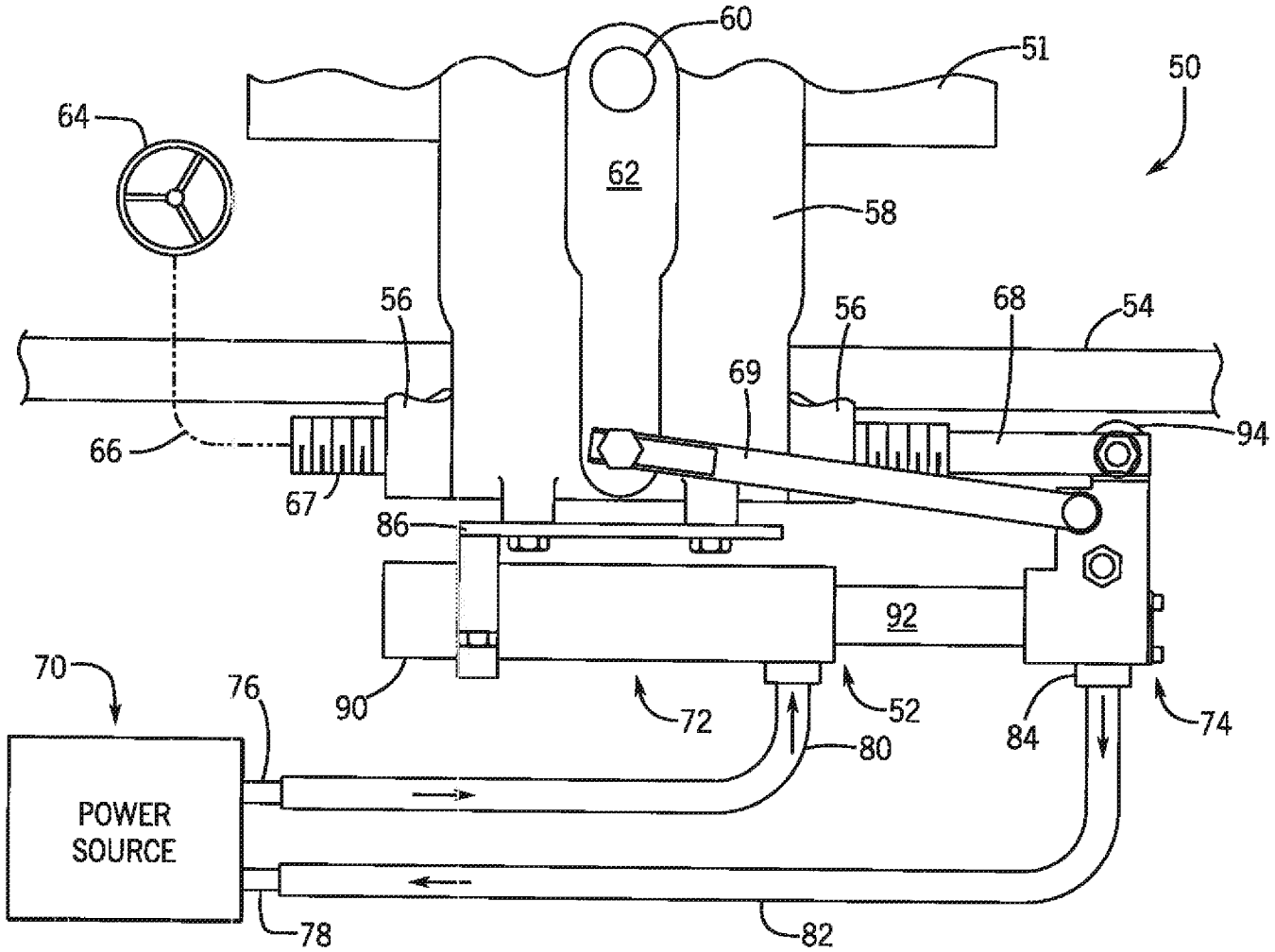
FIG. 1 schematically illustrates a marine power steering system constructed in accordance with an embodiment of the invention and mounted on the transom of a boat.

Turning now to the drawings and initially to FIG. 1, a cable steering system having a power steering system constructed in accordance with the present invention is illustrated. The system is shown in conjunction with an outboard motor 51 shown as being mounted on the transom 54 of a boat by transom mounts 56. As is typical, a stationary swivel mount 58 is mounted on the exterior surface of the transom 54 by the transom mounts 56. The motor 51 is supported on a pivot shaft 60 located behind the transom 54 and can tilt about a horizontal axis by moving about a horizontal engine tilt tube 67. Shaft 60 is rotatably supported on the swivel mount 58 and is driven to rotate about a generally vertical axis by a steering arm 62. The steering arm 62 is driven by the cable steering system 50 and/or the power steering system 52. Steering commands are generated by a steering mechanism 64 such as a steering wheel coupled indirectly to the steering arm 62 by a cable 66, a steering ram 68, and a steering link 69. The steering system 50 thus can be considered a "cable steering system," though the invention is also applicable to systems actuated by linkages and devices other than cables and can be used with marine propulsion systems other than outboard motors.

Still referring to FIG. 1, the power steering system 52 includes a power source 70 and an actuator assembly comprising a hydraulic cylinder or steering cylinder 72 and an actuator block 74. The power source 70 is mounted in the boat. It typically comprises an integrated pump/reservoir having a pressurized fluid outlet 76 coupled to the outlet of an internal pump and an unpressurized inlet 78 that opens into the reservoir. The outlet 76 delivers hydraulic fluid to the cylinder 72 via a supply hose 80, and the inlet 78 receives fluid via a return hose 82 coupled to a port 84 on the actuator block 74.

Figure 2A:
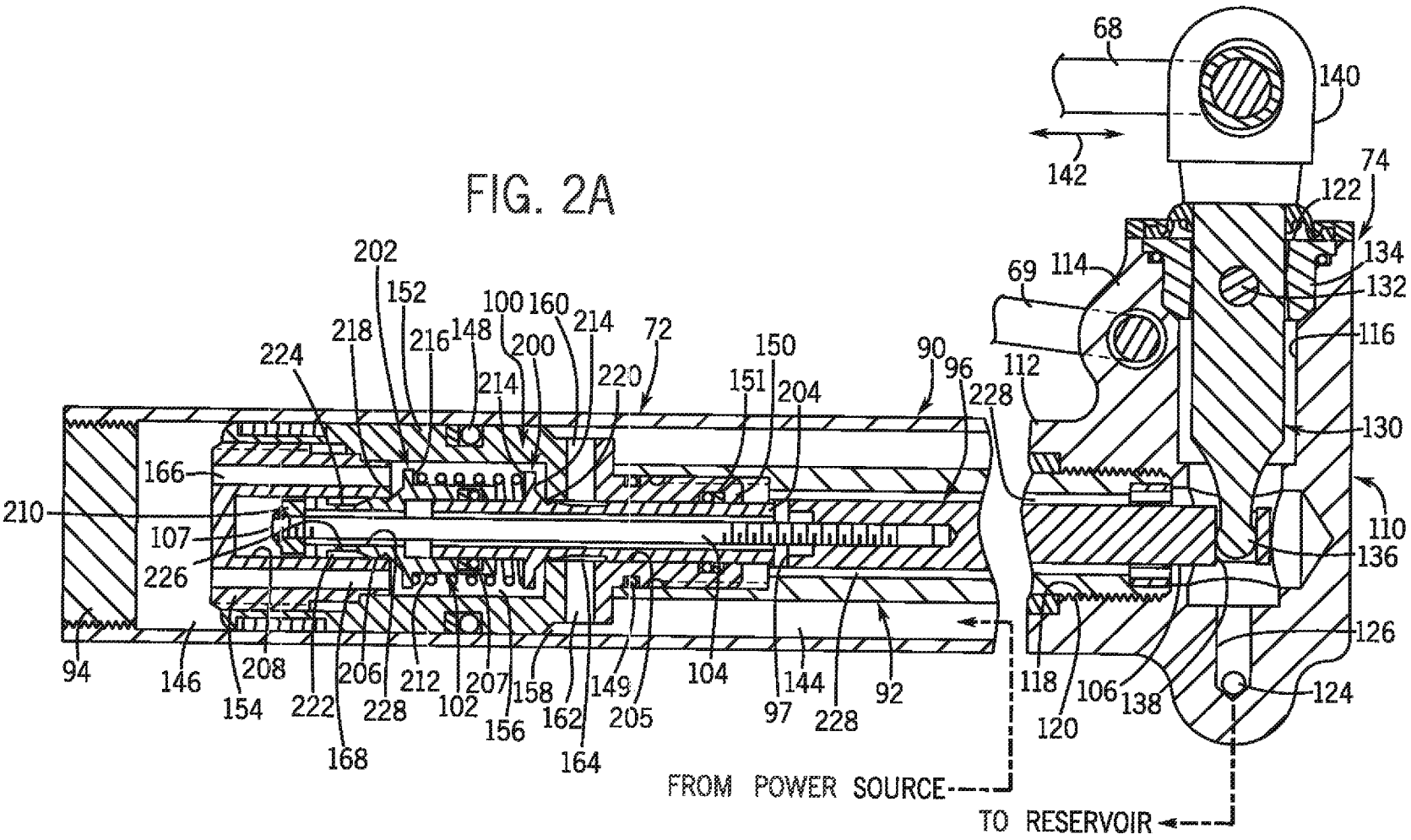
FIG. 2A is a cross-sectional elevation view of an actuator assembly of the marine power steering system of FIG. 1, showing the actuating assembly in a neutral position thereof.
Figure 2B:
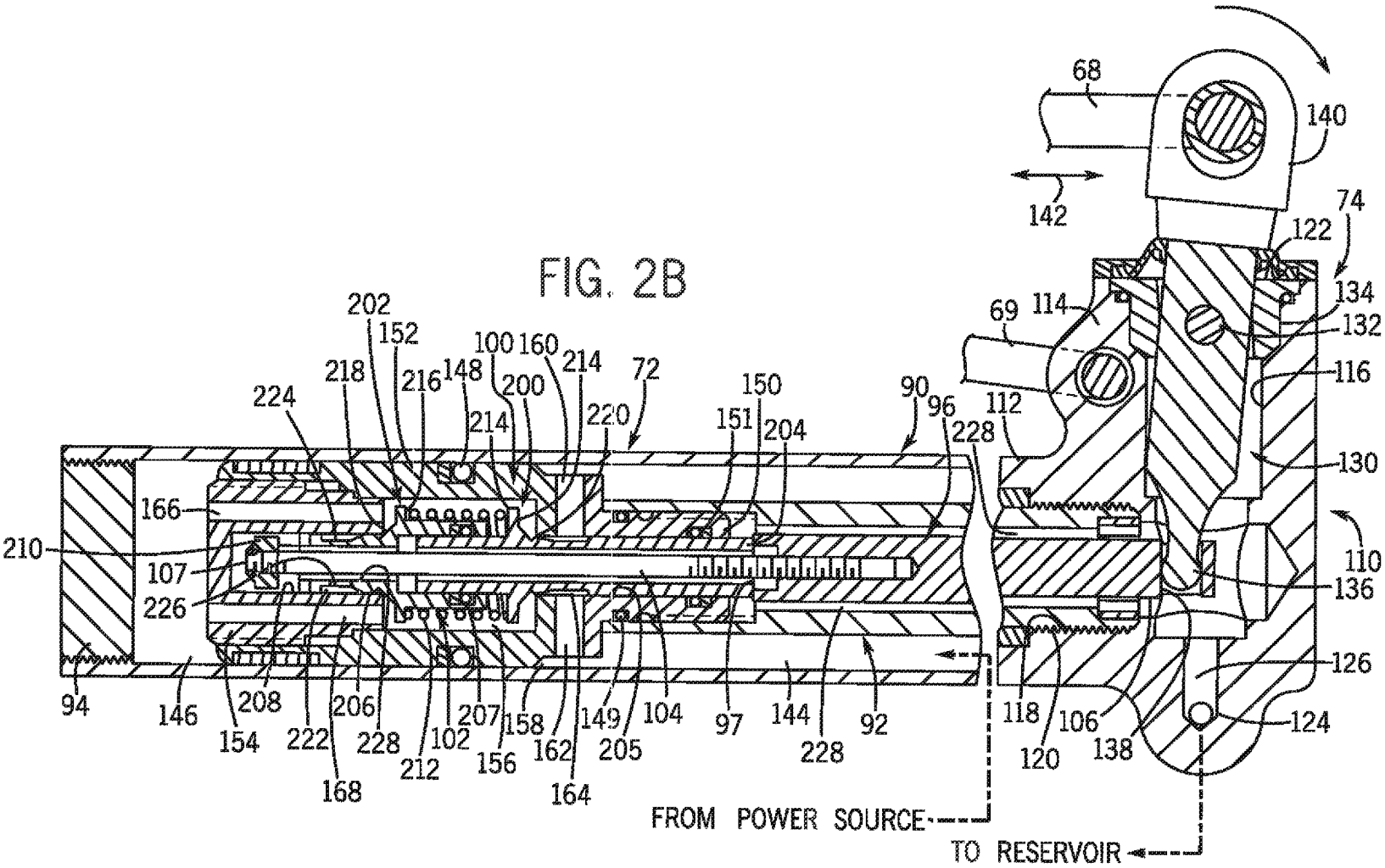
FIG. 2B corresponds to FIG. 2A and illustrates the actuator assembly in a first actuated position thereof.

Referring to FIGS. 1-2B, the hydraulic cylinder 72 includes a barrel 90 and a ram 92. The barrel 90 is fixedly mounted on the swivel mount 58 by a bracket assembly 86. The barrel includes a cylindrical body that is open at its outer end and closed at its inner end by a cap 94 (FIGS. 2A and 2B). Ram 92 extends from and retracts into the barrel 90 under the flow of hydraulic fluid to and from the hydraulic cylinder 72. The ram 92 is hollow. A piston assembly 100 is provided at the inner end of the ram 92 and houses a valve assembly 102. The actuating rod 96 has an inner end portion 104, an intermediate valve entrapment surface 106, and an outer end 107 extending outwardly from the ram 92 and an opening in the actuator block 74. A nut 210 is threaded onto the innermost end 107 of actuating rod 96.

The actuator block 74 will now be described with reference to FIGS. 2A-2B. The actuator block 74 includes a generally cylindrical body 110 having a boss 112 facing the hydraulic cylinder 72. A yoke 114 is provided on the body 110 at a location above the boss 112 for connection to the steering link 69. A cavity 116 opens into the body 110 from above, and a bore 118 extends axially inwardly from the cavity 116 and through the boss 112. The bore 118 is internally threaded so as to permit the body 110 to be mounted on threaded end 120 of the ram 92 so that the actuator block 74 translates with the ram 92. The cavity 116 has an upper opening 122 and is connected to a lower opening 124 in the body 110 via a vertical passage 126. The lower opening 124 is in fluid communication with the return hose 82 and the reservoir. An actuator, which in this embodiment comprises a control stem 130, is mounted in the cavity 116 so as to be pivotable within cavity 116 about a pivot axis defined by a pin 132. Pin 132 extends through control stem 130 and into a collar 134 mounted in the upper portion end of the cavity 116. The lower end of the control stem 130 terminates in a ball 136 which is received in a socket 138 in the outer end of the actuating rod 96. The upper end of the control stem 130 protrudes from the body 110 and terminates in a yoke 140 that receives the end of the steering ram 68. Movement of the steering ram 68 in the direction of arrow 142 in FIG. 2A causes the control stem 130 to pivot about the pin 132 to drive the actuating rod 96 into or out of the ram 92 to actuate the valve assembly 102, causing the ram 92 to move into or out of the barrel 90.

Still referring to FIGS. 2A and 2B, piston assembly 100 generally includes an outer nipple 150 threaded into the ram 92, a central body portion 152, and an inner end cap 154. The central and outer portions are sealed in the barrel 90 by respective seals 148 and 149. The body portion 152 of the piston assembly 100 has a central cavity 156 that houses the valve assembly 102. Body portion 152 includes a circumferential groove 158 at its outer axial end that forms an inner end of a chamber 144. Chamber 144 surrounds a portion of the ram 92 is connected to an inlet port (not shown) receiving pressurized fluid from the source 70 and hose 80 of FIG. 1. A series of passages, two of which are shown at 160 and 162, connect groove 158 to a central passage or groove 164. Central passage 164 also selectively communicates with the central cavity 156 in the body portion 152 as described in more detail below. Axial passages 166 and 168 extend through the end cap 154 from cavity 156 and open onto a control chamber 146 formed between the inner end of the piston assembly 100 and the barrel end cap 94.

Still referring to FIGS. 2A and 2B, the valve assembly 102 is selectively adjustable to 1) isolate the control chamber 146 from the power source and the reservoir, thus maintaining the ram 92 stationary, 2) connect the control chamber 146 to the high pressure outlet of the pressure source while isolating chamber 146 from the reservoir, thus causing the ram 92 to extend, and 3) connect the control chamber 146 to the reservoir while isolating chamber 146 from the high pressure outlet of the pressure source, thus causing the ram 92 to retract. Valve assembly 102 includes a normally closed extend valve 200 that is openable to cause the ram extension, and a normally closed retract valve 202 that is openable to cause ram retraction. The extend valve 200 is slidably disposed in the inner end of a bore 205 formed in outer nipple 150 of piston assembly 100. The extend valve 200 has, amongst other features described below, a projection 204 at its outer or upstream end that extends through and projects axially outwardly from the inner end of the nipple 150 of the piston assembly 100. Projection 204 also is sealed to the nipple 150 via a seal 151. The above-described groove 164 is formed in projection 204. Retract valve 202 similarly includes, amongst other features, a portion 206 at its inner or downstream end that is slidably received within a bore 208 formed in piston end cap 154. An outer axial end portion of the retract valve 202 surrounds the inner axial end portion of the extend valve 200 and is sealed to the extend valve 200 by a seal 207. Extend valve 200 and retract valve 202 are each formed with an axial internal passage that receives the inner end portion 104 of the actuating rod 96.

A spring 212 bears against facing surfaces 214, 216 formed on the extend valve 200 and the retract valve 202, respectively. The spring 212 urges the extend valve 200 into sealing engagement with a seat 220 formed at the inner opening of the bore 205 provided at the outer axial end of the body portion 152. The spring 212 also urges the retract valve 202 into sealing engagement with a seat 218 provided at the inner end of the bore 208 in the piston end cap 154. An annular groove or chamber 222 is provided in the projecting portion 206 of retract valve 202. A pair of radial passages 224, 226 connects the groove 222 to and annular chamber 228 surrounding the actuating rod 98. The annular chamber 228 extends the length of the actuating rod and opens into cavity 116 and, ultimately, to the reservoir. By the action of spring 212 urging the extend and retract valves 200 and 202 into sealing engagement with the seats 218, 220, the grooves 164 and 222 are fluidically isolated from the central cavity 156 when the extend and retract valves 200 and 202 are closed, isolating cavity 156 from both the pressure source and the reservoir.

Each of the extend and retract valves 200 and 202 is designed to control flow therethrough so that, at a given system pressure, the flow rate of fluid through the valve is limited to a relatively low and generally constant value through an initial portion of the valve stroke to restrict the rate of ram extension and retraction and prevent valve chatter. The flow rate then increases non-linearly during additional opening movement of the valve.

Figure 4:
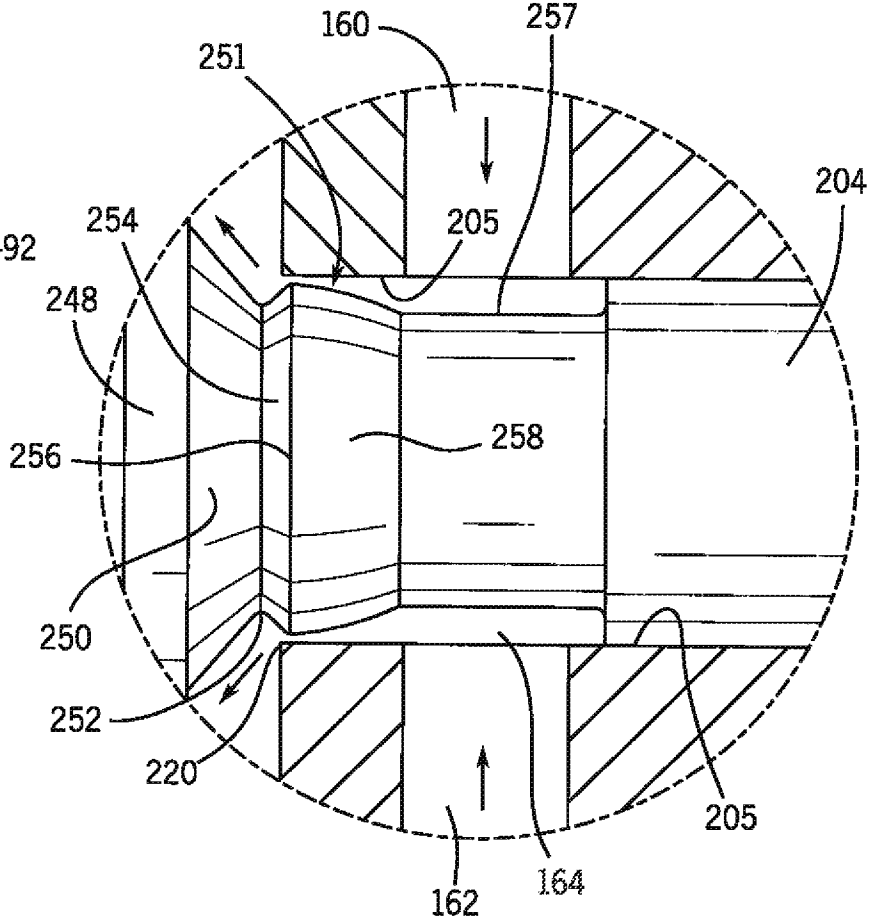
FIG. 4 is a fragmentary detail view of the portion of the extend valve designated 4-4 in FIG. 3 and showing the valve in the partially open state thereof.
Figure 3:
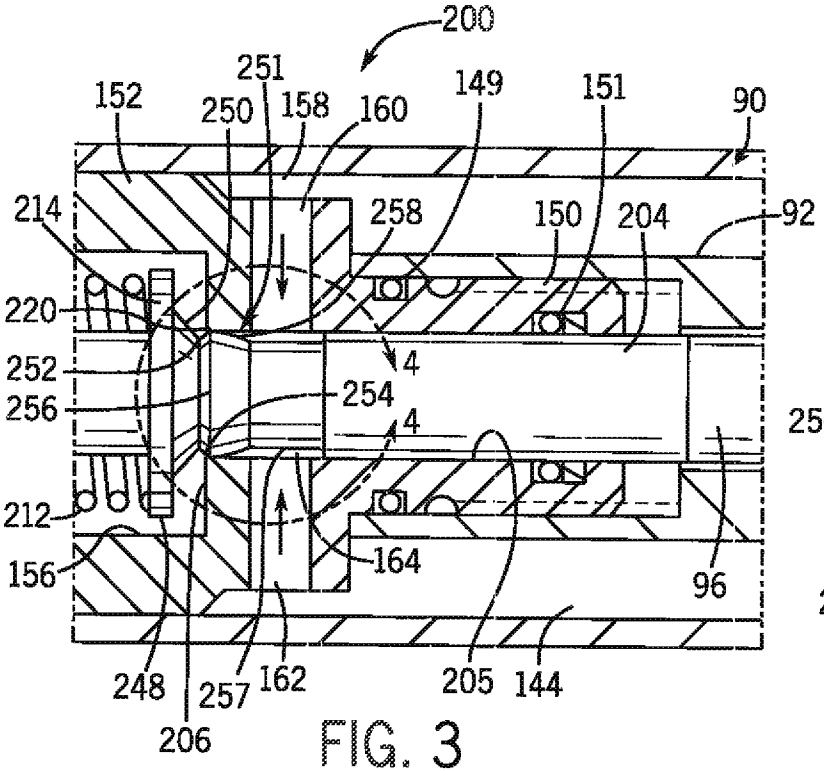
FIG. 3 is a detail view of an extend valve of the actuator assembly of FIGS. 2A and 2B and showing the valve in a partially open state thereof.

The extend and retract valves 200 and 202 are essentially mirror images of one another. Referring to FIGS. 3 and 4, the extend valve 200 thus will be described, it being understood that the description applies generally equally to the retract valve 202. Extend valve 200 is slidably disposed in the bore 205. When viewed in the direction of fluid flow through the bore 205, it also includes a head 248, a sealing surface 250 extending upstream from the head 248, and a valve body 251 extending upstream from the sealing surface. The spring 212 abuts against the head 248. The sealing surface 250 extends radially inwardly and axially outwardly from the head 248 to and beyond a location at which it seals against the seat 220 when the valve 200 is closed. The sealing surface 250 terminates in a relatively smaller diameter surface portion 252 of the body 251.

Another surface portion 254 of the body extends axially outwardly and radially in the direction of fluid flow from portion 252 at an angle of; for example, 27° from the radial to a maximum diameter portion 256 that may be of negligible axial length. The diameter of portion 256 is the maximum effective diameter of the valve 200. Maximum diameter portion 256 defines the maximum effective diameter of the valve 200 because an annular gap between the maximum diameter portion 256 and the bore 205 defines a flow path of minimum diameter through the valve 200. Discounting the effects that the sealing surface 250 has on fluid flow through the valve 200 in the early phases of valve opening, the "effective flow area" of the valve 200, defined as the cross sectional area of the gap between the bore 205 and the widest portion of the valve body 251 remaining in the bore 205 at any given point in the opening stroke of the valve 200, is at minimum at this location. Upstream beyond portion 256, a curved metering portion 258 of the body 251 extends radially inwardly to an undercut portion 257 on the valve 200 that forms the inner surface of the groove 164. The metering portion 258 may have a radius of for example, 0.250 and extend through an axial length of about 0.1" to 0.2". Due to the curvature of this portion 258, the effective flow are of the valve 200 increases progressively and non-linearly, i.e., at an accelerating pace, when the effective flow area of the valve 200 is governed by metering portion 258.

Figure 5:
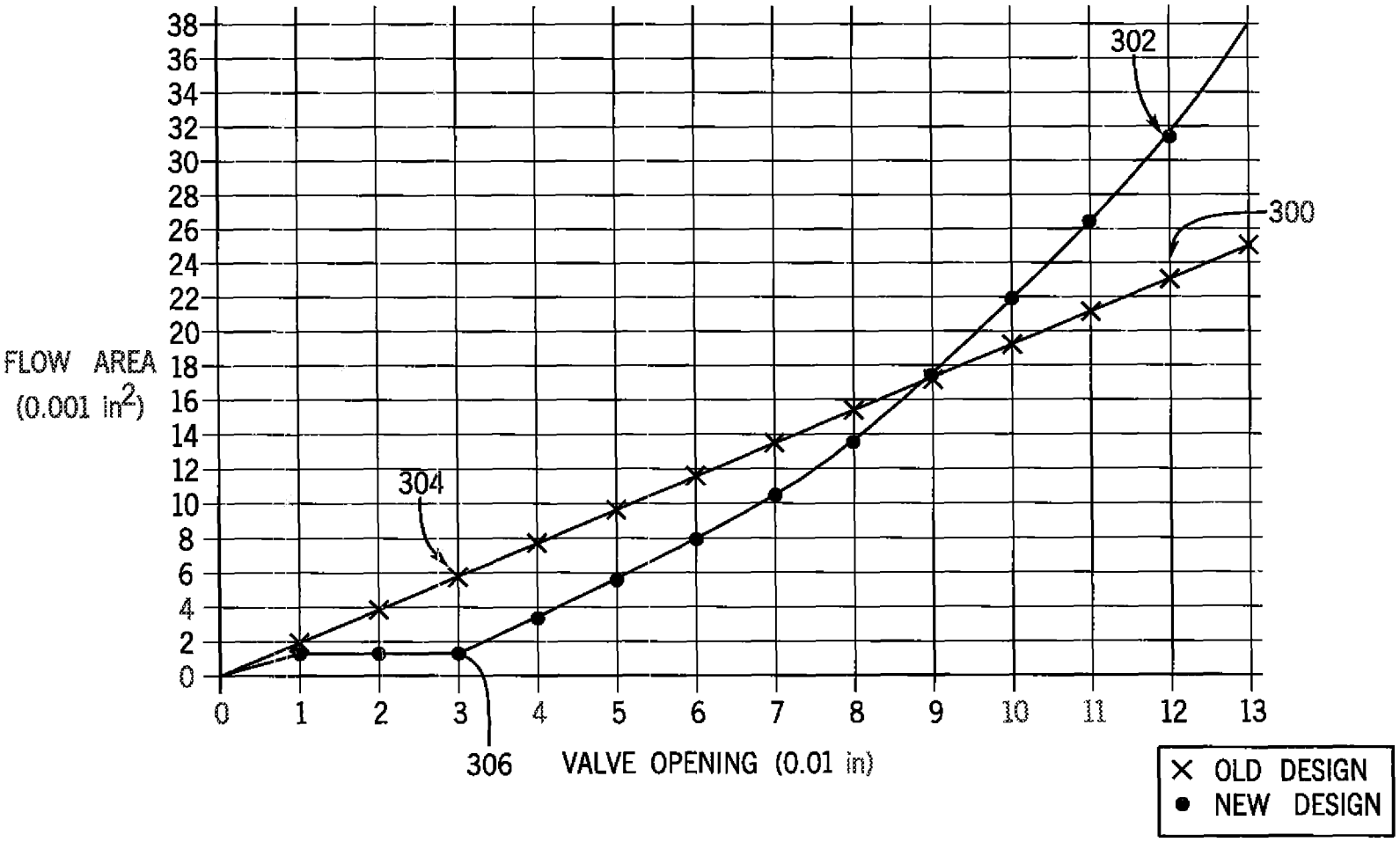
FIG. 5 is a family of curves comparing flow characteristics of one of the valves of the marine power steering system of FIGS. 1-4 to a prior art valve.

In operation, actuation of the extend valve 200 by leftward or inward movement of the actuating rod 96 moves valve 200 off its seat 220 to permit fluid to flow through the passage 164, past valve seat 220, and into cavity 156, causing the ram 92 to extend from the barrel 90 as will be described in greater detail below. The manner in which that flow depends on the magnitude of valve opening will now be described on a comparative basis with a prior art valve. The curves 300 and 302 in FIG. 5 plot valve stroke from a closed position vs. flow area for a prior art extend valve and for an extend valve constructed in accordance with this embodiment of the invention, respectively. The prior art valve is characterized by a valve body that is inclined linearly downwardly and outwardly from the base of the sealing surface so that the effective area of the valve increases linearly throughout the valve opening stroke. Referring to the curve 300 in FIG. 5, the effective flow area and thus the flow rate at a given pressure increase fairly rapidly so that the effective flow area is 0.004 $in^2$ after only 0.02" of valve stroke and is 0.06 $in^2$ after only 0.03" of valve stroke. This equates to relatively rapid ram extension even at small magnitudes of operator input and could lead to undesirable valve chatter. Valve chatter can occur if the ram momentarily moves faster than the input, causing the valve to reseat, which reduces fluid flow though the valve and slows the rate of ram extension then reopens, causing in a rapid or "jerky" movement of the ram. There are many factors involved that can cause this to happen.

During operation of the valve 200, however, the effective flow area of the valve and thus the fluid flow rate through the valve are limited significantly during the early phases of valve opening due to the influence of the maximum diameter portion 256 of body 251 on fluid flow through the valve 200. The curve 302 indicates that the effective flow area increases to about 0.0015 $in^2$ after the valve 200 opens and remains at that level until the trailing edge of the portion 256 clears the seat 220 at the end of a first subsequent portion of the valve's stroke. That portion is about 0.03" in this embodiment. Comparing point 304 in curve 300 to point 306 in curve 302, the effective flow area of the valve 200, is only about ⅓ that of a prior art system at this level of steering input. The possibility of valve chatter therefore is greatly reduced. As the valve 200 opens further in a second subsequent portion of the valve's stroke, the effective flow area begins to increase because of the decreasing diameter of the curved metering portion 258. The ram 92 thereafter extends faster due to increased fluid flow through the valve 200, with the fluid flow and the rate of ram extension increasing progressively with progressive valve movement and a resultant increase in the effective flow area. The effective flow rate through the valve 200 and thus the ram extension rate surpasses that of the prior art valve at point 310 where the curves 300 and 302 intersect and, then continues to increase.

As mentioned above, the same valve design is used for the retract valve 202. When closed, the retract valve 202 isolates the chamber 146 from an end of groove 222, thus preventing fluid flow through the passages 224, 226, 228, out of the port 124, and to the reservoir. When the retract valve 202 is open, chamber 146 is connected to the groove 222, permitting fluid to flow through the groove and passages 222, 224, and 226, out of the port 124, and to the reservoir at a rate that depends on the magnitude of valve opening which, in turn, depends on the magnitude of actuating stem stroke, thus causing the ram 92 to retract into the barrel 90.

In operation of the system as a whole, when no steering forces are imposed on the central stem 130 so that it remains in its position as shown in FIG. 2A, the extend and retract valves 200 and 202 are closed, preventing movement of the ram 92 relative to barrel 90. To extend ram 92, yoke 140 is moved rightwardly by operation of steering ram 68 so as to cause clockwise pivoting of control stem 130 about pin 132, as shown in FIG. 2B. This movement of control stem 130 causes leftward movement of actuating rod 96 within ram 92. When this occurs, an abutment face 97 on the actuating rod 96 engages the outer axial end of the projecting portion 204 of extend valve 200. Continued actuating rod motion results in inward movement of extend valve 200 against the force of spring 212, moving the sealing surface 250 of extend valve 200 out of engagement with seat 220. Pressurized fluid flows from high pressure chamber 144 and through the extend valve 200 at rate that is dependent on the extent of valve opening. Pressurized fluid then flows from cavity 156, through passages 166 and 168, and into chamber 146, driving the piston assembly 100 to the right as seen in FIG. 2B to extend the ram 92. This extension of ram 92 causes rightward movement actuation of block 74, and thus the steering link 69, so as to pivot engine 58 through arm 62 (FIG. 1). This movement is slow during small actuating arm strokes and is faster during larger strokes.

When the desired steering effect has been attained by extension of the ram 92, the operator ceases turning the steering wheel, thereby resulting in movement of control stem 130 to its neutral position as shown in FIG. 2A. This moves abutment face 97 of the actuating rod 96 out of engagement with the rightward end of extend valve projecting portion 204, and spring 212 then returns extend valve 200 to its closed position, thereby cutting off communication of chamber 144 with cavity 156 and chamber 146. The position of ram 92 thus is maintained relative to barrel 90, maintaining the desired angular position of the motor relative to the boat.

When it is desired to turn the motor in the opposite direction, the operator turns the steering wheel so as to actuate steering cable 66 to cause the steering ram 68 to drive the control stem 130 to pivot counterclockwise about pin 132. When in this position, control stem 130 causes rightward movement of actuating rod 96. Such movement causes the nut 210 on the actuating rod 96 to drive the retract valve 202 against the bias of spring 212, opening the retract valve 202. Fluid then flows from chamber 146, through passages 166 and 168 and chamber 156, through retract valve 202, into groove 222, through passages 224 and 226, into and through annular chamber 228, and out of the port 124 to the reservoir. Fluid pressure in chamber 144 then drives the piston assembly 100 to the left to retract the ram 92. As with the extend valve 200, fluid flows through the retract valve 202 at a rate that is dependent upon the extent of retract valve opening. This retraction of ram 92 results in rotation of engine 58 at a rate that is slow for low steering inputs and faster for high steering inputs.

When the desired position of the engine is attained, the operator stops turning the steering wheel to remove actuation forces from the control stem 130. Accordingly, spring 212 once again biases retract valve 202 to its closed position, thereby insolating chamber 146 from the reservoir and maintaining ram 92 in its existing position.

Figure 6:
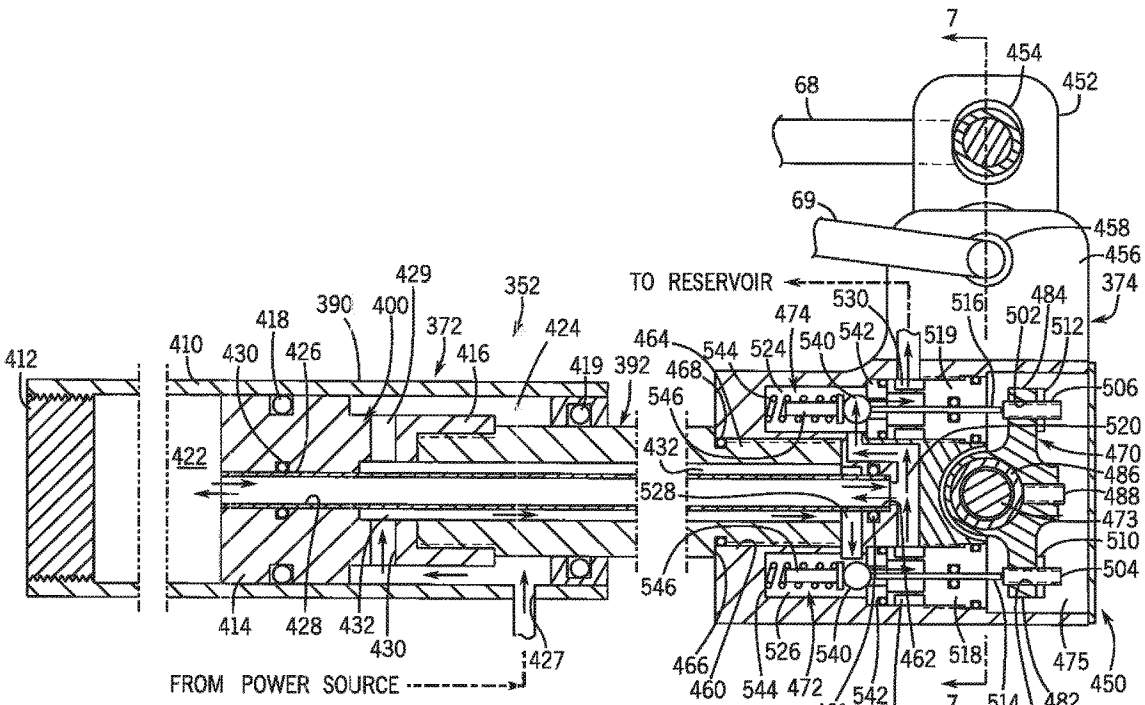
FIG. 6 is a sectional side elevation view of an actuator assembly constructed in accordance with a second embodiment of the invention and illustrating the actuator assembly in a neutral state thereof.
Figure 8:
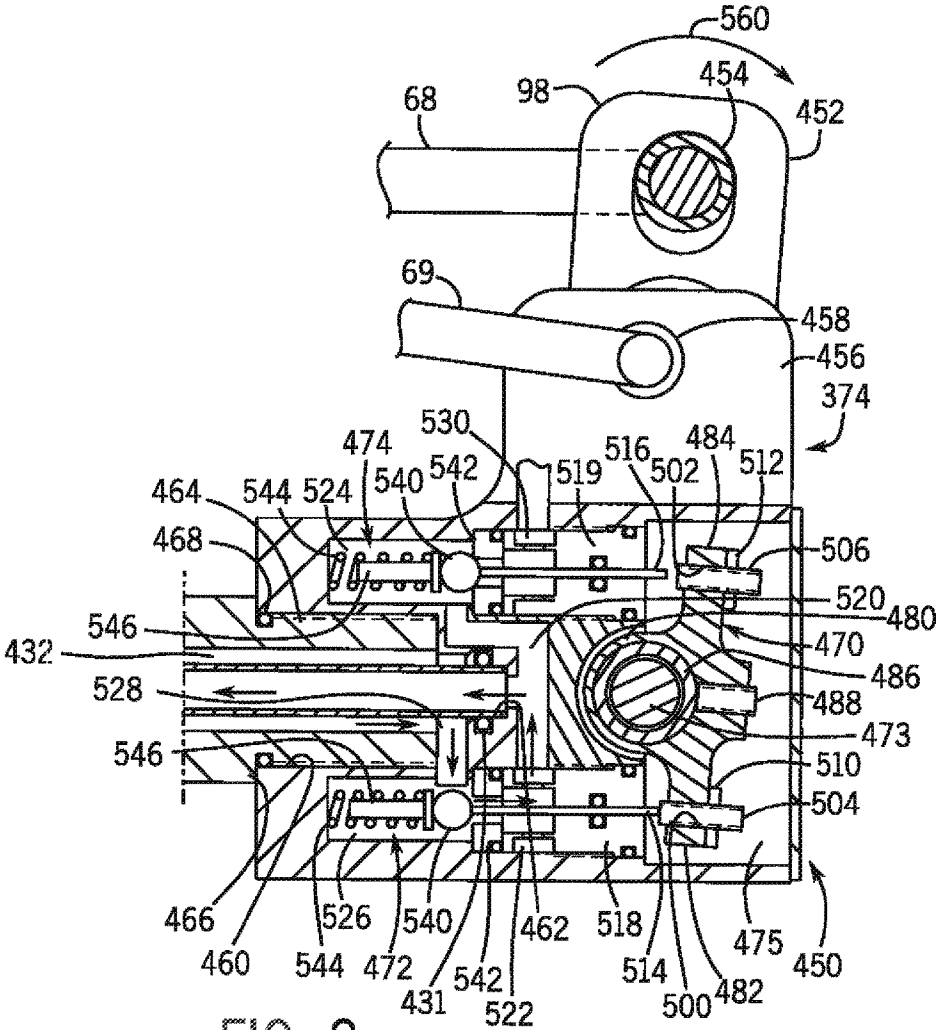
FIG. 8 is a fragmentary sectional side elevation view of the actuator assembly of FIGS. 6 and 7, showing the assembly in an actuated state thereof.
Figure 7:
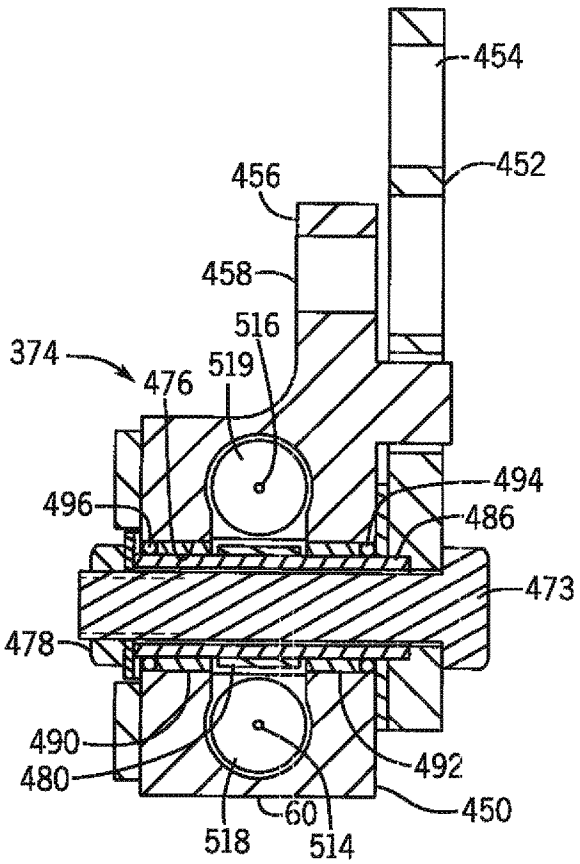
FIG. 7 is a sectional end elevation view taken along the line 7-7 in FIG. 6.

Turning now to FIGS. 6-8, an actuator assembly 352 is constructed in accordance with another embodiment of the invention in which the valve assembly is contained within the actuator block 374 as opposed to being contained within the piston and cylinder assembly 372. The actuator assembly 352 is designed to be mounted on a transom of a boat in at least generally the same manner as the actuator assembly of FIGS. 1-4 and to be connected to a steering link 69 and a steering ram 68 as described above in connection with the first embodiment Inlet and outlet ports are connected to the high-pressure outlet of the power source and to the reservoir, also as described above in connection with the first embodiment.

Also, as in the first embodiment, the actuator assembly 352 includes a stationary barrel 390 and a ram 392 that is movable linearly into and out of the barrel 390. The barrel 390 includes a cylindrical body 410 and a fixed inner endcap 412. The ram 392 of this embodiment includes a stepped piston 400 having an inner end portion 414 of increased diameter and an outer end portion 416 of reduced diameter. The inner end portion 414 of piston 400 is sealed to the interior of the barrel body 410 by a seal 418. The outer end portion 416 of piston 400 is threaded onto an inner end of the ram 392, which is sealed to the interior of barrel body 410 by a seal 419. Chambers 422 and 424 are formed on opposite sides of inner end portion 414 of the piston 400. A hollow tube 426 extends axially through the ram 392. Tube 426 presents an internal passage 428 having an inner end communicating with the chamber 422 and outer end that opens into a control chamber 520 formed in the actuator block as detailed below. The inner end portion of the tube 426 is sealed to the piston 400 by an O-ring 430. The outer end portion of the tube 426 is sealed to an internal surface of the actuator block 374 by another O-ring 431.

The chamber 424 is an annular chamber formed between the outer surface of the reduced diameter portion 416 of the piston 400 and the inner radial surface of the barrel 390. This chamber 424 communicates with the high-pressure inlet via a supply passage 427. Radial passages 429 and 430 connect chamber 424 to an annular passage 432 surrounding the tube 426. The outlet of the annular passage 432 opens into the valve assembly as discussed below.

Still referring FIGS. 6 and 7, the actuator block 374 includes an actuator body 450 and an actuator in the form of an actuating lever 452 pivotally mounted on an outer surface of the actuator body 450. The actuating lever 452 extends beyond the actuator body 450 and has a yoke 454 for connection to the steering ram 68. A tab 456 is also provided on the body 450. Tab 456 presents a yoke 458 for connection to the steering link 69. The body 450 has a stepped axial bore having a relatively large diameter inner end 460 and a small diameter outer end 462. The inner end 460 of the stepped bore threads onto an externally threaded neck 464 on the outermost end portion of the ram 392. The innermost end of the body 450 seats against a shoulder 466 on the ram 392 and is sealed to the neck 464 of the ram 392 by an O-ring seal 468. The outermost end 462 of the stepped bore seals against the O-ring seal 431 on the outer end of the tube 426.

Still referring to FIGS. 6 and 7, a rocker assembly 470 and a control valve assembly 472, 474 are housed in a cavity 475 of the interior of the actuator body 450. The control valve assembly includes two valves 472 and 474 that are located on opposite sides of the longitudinal axis of the ram 392 and that thus are readily actable by the rocker assembly 470, which rocks about that axis. Each valve 472, 474 is housed in a respective cavity 526, 524. The rocker assembly 470 is mounted on a bolt 473 that is received in a through bore 476 in the body 450 (FIG. 7) and held in place by a nut 478. Assembly 470 includes an annular yoke 480 and first and second rocker arms 482 and 484 that extend laterally outwardly from a center of the yoke 480. The yoke 480 is fastened to a sleeve 486 by a set screw 488 extending through the center of the yoke. As best seen in FIG. 8, the sleeve 486 surrounds the bolt 473 and is kept centered in the bore 476 by bushings 490, 492. O-ring seals 494 and 496 are provided at the ends of the bushings 490 and 492. The outer end of the sleeve 486 is connected to an inner end of the actuating lever 452. The sleeve 486 thus is rotatable with the bolt 473 upon pivoting movement of the actuating lever 452, hence causing the rocker assembly 470 to rock.

Still referring especially to FIG. 7, each rocker arm 482 and 484 has a tapped bore 500, 502 that receives an externally-threaded adjustment screw 504, 506 that extends through the bore 500, 502 of the respective rocker arm 482, 484. Each screw 504, 506 acts as a valve actuator that imparts actuating forces to an associated valve 472 or 474 through a corresponding pin 514, 516. The effective length of each screw 504, 506, i.e. the distance it extends inboard of the associated rocker arm 482, 484, can be adjusted by threading it into or out the bore 500, 502, and the screw 504, 506 can then be locked in place using a lock nut 510, 512. Due to this construction, pivotal movement of the rocker assembly 470 due to translation of the actuating lever 452 causes the rocker assembly 470 to pivot or rock about the central axis of the bolt 473. This movement causes one or the other of the adjustment screws 504 or 506 to engage an associated actuator pin 514 or 516 to open an associated valve 472 or 474 as detailed below. Each actuator pin is slidably guided in a corresponding guide block 518 or 519.

Referring particularly to FIG. 8, a control chamber 520 is formed in the body 450 outbound of the end of the tube 426. Control chamber 520 has an inlet in fluid communication with a first chamber containing an extend valve 472, an outlet in fluid communication with a second chamber containing the retract valve 474, and a control port opening into the outboard end of the hollow tube 426. The extend valve 472 selectively connects the control chamber 520 to the high pressure chamber 526 housing the valve 472. Chamber 526 is in fluid communication with the annular passage 432 in the ram 392 via a cross passage 528. The retract valve 474 selectively connects the control chamber 520 and the chamber 524 that houses the valve 474 to a low pressure chamber 530. Chamber 530 is in fluid communication with the outlet port leading to the reservoir.

Each of the extend and retract valves 472 and 474 is of identical construction. The extend valve 472 therefore will be described in detail, it being understood that the description applies equally to the retract valve 474.

The extend valve 472 is a ball-type check valve having a ball 540 that is normally sealed against a seat 542 separating the control chamber 520 from the high-pressure chamber 526. The ball 540 is urged against the seat 542 by a spring assembly including a coil spring 544 and a spring guide 546 that has a head that engages the ball 540. The seat 542 is hollow so as to define a central through-passage that receives the actuator pin 514. Movement of the actuator pin 514 upon engagement of the associated adjustment screw 504 therewith due to rocker assembly motion drives the ball 540 off the seat 542 to allow fluid in the high pressure chamber 526 to flow past the ball 540, through the hollow seat 542, into an intermediate chamber 522, and into the control chamber 520. The fluid can then flow through the tube 426 and into chamber 422. Similarly, movement of the ball 540 of the retract valve 474 off the seat by motion of the actuator pin 516 causes fluid to flow from control chamber 520, into chamber 524, past the ball 540, through the hollow seat 542, and into the low pressure chamber 530 before flowing out of the actuator assembly 352 and to the reservoir.

In operation, the actuating lever 452 and the remaining components of the system 352 assume the position illustrated in FIGS. 6 and 7 in the absence of the imposition of steering forces on the steering ram 68. At this time, both the extend and retract valves 472 and 474 are closed, and fluid flow into or out of the cylinder assembly 372 is prohibited, locking the ram 392 in place relative to the barrel 390.

To steer the boat, actuation of the wheel or other input in a desired direction translates the steering ram 68 to cause the actuator lever 452 to swing in one direction or the other about the bolt 473. Hence, referring to FIG. 8, movement of the actuator ram 68 in the direction of arrow 560 causes the rocker assembly 470 to pivot clockwise. This pivoting motion causes the actuating screw 504 to drive the actuator pin 514 to the left as viewed in FIG. 8, driving the ball 540 of the extend valve 472 off its seat 542 against the biasing force of the spring 544. Pressurized fluid thereafter flows into the inlet passage 427 and into high pressure chamber 424. Fluid in the high pressure chamber 424 then flows through passages 429 and 430 and into annular chamber 432. Fluid in chamber 432 then flows through the cross passage 528, through the high-pressure chamber 526, past the extend check valve 472, through the seat 542 and the chamber 522, and into the control chamber 520. The pressurized fluid then flows inwardly through the hollow tube 426 and into the chamber 422, forcing the piston 400 to the right to extend the ram 392. When the manual input is stopped to relieve the actuating force from the actuating lever 452, the system continues to move a brief time until the check ball 540 of valve 472 is reseated, whereupon further ram movement is prevented.

When the actuating lever 452 is moved in the opposite direction or counterclockwise as seen in the drawings, the rocker assembly 470 will pivot counterclockwise, causing the adjustment screw 506 to engage the actuator pin 516 and drive the ball 540 of the retract valve 474 from the seat 542. Fluid in chamber 422 now flows through the internal passage 428 in the tube 426, into the control chamber 520, through chamber 524, past the retract valve 474, into the low pressure chamber 530, and out to the reservoir. Pressurized fluid then flows into the chamber 424 from the pressure source and the passage 427, driving the piston 400 to the left and causing the ram 392 to retract. When movement of the actuating lever 452 stops due to the release of manual forces, the system will continue to move for a brief time until the check ball 540 of valve 474 reseats on the seat 542.

The actuator assembly of FIGS. 6-8 has several advantages over prior known assemblies. Because the valving is located in a common port in the actuator body, the valving can be easily assembled or accessed for repair without having to completely disassemble the piston and cylinder assembly 372. The valves 472 and 474 also need not be constructed to close tolerances, and valve clearance can be easily adjusted using the adjusting screws. The check valves also provide a simple, reliable sealing system. Finally, if desired, the pressure source line could be routed to the chamber 526 on the actuator block, making for a simpler cylinder endcap.

Although the best mode contemplated by the inventor of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

I claim:

1. A power steering system for a marine steering system, the marine steering system comprising a pivotable outboard motor and a steering actuator operationally coupled to the outboard motor via a steering link, the power steering system comprising:

a. a hydraulic cylinder having a barrel and a ram that moves into and out of one end of the barrel;

b. an actuator block that is mounted on an outer end of the ram, the actuator block including an actuator body and an actuator that is mounted on the actuator body, the actuator being configured to move relative to the actuator body upon the transmission of steering command forces thereto; and c. valving that is located within the actuator block and that is configured to respond to actuator movement to control the flow of hydraulic fluid to and from the hydraulic cylinder to cause the ram to extend into the barrel and retract from the barrel, wherein the valving comprises ball-type extend and retract check valves located in the actuator block, and wherein fluid flows through the valving only when one of the extend valve and the retract valve is actuated by the actuator.

2. The marine power steering system as recited in claim 1, wherein the extend and retract valves are located on opposite sides of an axial centerline of the ram, and further comprising a rocker assembly that rocks in response to actuator movement to actuate the extend and retract valves.

3. The power steering system as recited in claim 2, wherein the actuator comprises an actuating lever that is mounted on a body of the actuator block and that is coupled to the rocker assembly so that the rocker assembly rocks upon swinging movement of the actuating lever relative to the body of the actuator block.

4. The power steering system as recited claim 2, wherein the rocker assembly includes first and second rocker arms, each of which is associated with a respective one of the extend valve and the retract valve.

5. The power steering system as recited in claim 4, further comprising adjustable valve actuators mounted on the rocker arms, each of which has a driving surface the position of which can be adjusted relative to the associated rocker arm by adjusting the position of the valve actuator on the rocker arm.

* * * * *